US005664774A

United States Patent [19]

Walker et al.

[11] Patent Number: 5,664,774

[45] Date of Patent: Sep. 9, 1997

[54] SYNTHETIC LEATHER COVERED GAME BALL

[75] Inventors: Alan D. Walker, Somers, Conn.; John Uaszek, Westfield, Mass.

[73] Assignee: Lisco, Inc., Tampa, Fla.

[21] Appl. No.: 574,438

[22] Filed: Dec. 15, 1995

[51] Int. Cl.[6] ..... A63B 37/06; A63B 37/12

[52] U.S. Cl. ..... 473/600; 273/DIG. 8; 273/DIG. 9; 273/DIG. 6; 473/598

[58] Field of Search ..... 273/60 R, 60 A, 273/60 B, 58 A, DIG. 8, DIG. 6, DIG. 9

[56] References Cited

U.S. PATENT DOCUMENTS

| | | | |
|---|---|---|---|
| 3,976,295 | 8/1976 | Heald, Jr. | 273/60 R |
| 4,093,219 | 6/1978 | Piraud | 273/65 B |
| 4,149,720 | 4/1979 | Heald, Jr. | 273/60 R |
| 4,256,304 | 3/1981 | Smith et al. | 273/60 B |
| 4,333,648 | 6/1982 | Aoyama | 273/65 EB |
| 4,462,590 | 7/1984 | Mitchell | 273/65 E |
| 4,515,852 | 5/1985 | Katabe et al. | 428/246 |
| 4,653,752 | 3/1987 | Miller | 273/60 B |
| 4,660,830 | 4/1987 | Tomar | 273/60 B |
| 4,725,058 | 2/1988 | Molitor | 273/60 B |
| 4,840,378 | 6/1989 | Molitor | 273/60 B |
| 4,880,233 | 11/1989 | Song | 273/60 R |
| 5,069,935 | 12/1991 | Walters | 273/65 E X |
| 5,091,265 | 2/1992 | Kennedy et al. | 273/58 A X |
| 5,098,097 | 3/1992 | Kennedy et al. | 273/45 EC |
| 5,310,178 | 5/1994 | Walker et al. | 273/65 B |

*Primary Examiner*—George J. Marlo

[57] ABSTRACT

A softball has a high end synthetic leather stitched cover formed from a low density non-woven fiber mat impregnated with polyurethane. The softball, which can be formed to meet association specifications, has a circumference of 11 or 12 inches and a cover to core weight ratio significantly less than 0.1, typically in the range of 0.08–0.16, while meeting durability requirements. The cover preferably has a thickness of 0.045–0.065 inches. Because a greater weight concentration is in the core of the ball, the ball has improved playability characteristics over conventional balls having heavier synthetic leather covers, while exhibiting a sound comparable to that of a leather covered softball when struck with a bat.

20 Claims, 1 Drawing Sheet

SYNTHETIC LEATHER COVERED GAME BALL

FIELD OF THE INVENTION

The present invention relates to game balls used in diamond sports, and more particularly is concerned with balls, such as softballs, having highly durable, synthetic leather stitched covers.

BACKGROUND OF THE INVENTION

Conventional softballs have one of four different types of covers, namely full grain leather stitched covers, coated split leather stitched covers, synthetic stitched covers, or molded covers. Stitched covers customarily are formed from two separate pieces of leather or synthetic material which exhibit the traditional interfitting dumbbell configuration and are fastened together with herringbone stitching. The stitching forms ridges which enhance the gripping characteristics and desired aerodynamic properties of the ball.

Genuine leather traditionally has been deemed to be the best cover material due to its softness, texture and durability. Such material provides a firm but relatively soft cover that advantageously provides for potentially increased spin off of the bat, which can produce additional carry and lift, which in turn results in increased hitting distance. Furthermore, a leather-covered ball produces a solid crack-type sound when struck with a bat. This sound is not replicated by many synthetic ball covers.

All conventional softball cover materials are found to reduce the coefficient of restitution (C.O.R.) of the ball to a limited extent. However, leather traditionally has been found to result in a smaller reduction in coefficient of restitution of the ball than results from the use of synthetic or molded covers.

Synthetic leather softball covers typically are formed of polyvinyl chloride (PVC). While PVC covers have good resistance to wear and moisture, it is necessary to make such covers thicker than leather in order to obtain comparable durability and stitchability. Unfortunately, the thicker covers tend to dampen the sound when the bat hits the ball, thereby losing the solid crack players have come to expect, and also result in a greater reduction in the coefficient of restitution of the ball as compared to balls with thinner leather covers.

SUMMARY OF THE INVENTION

Accordingly, it is an object of the present invention to provide a new and improved game ball for diamond sports, particularly a softball, having a high performance, synthetic leather, stitched cover that exhibits the softness, durability, stitchability, low reduction in coefficient of restitution and sound of balls having full grain or coated split leather covers.

Another object of the present invention is to provide a ball of the type described having a synthetic leather stitched cover wherein the ball has play properties, such as spin, lift and distance carrying characteristics, which replicate, or are superior to, the properties of a ball having a leather stitched cover.

A further object of the present invention is to provide a synthetic covered ball for use in competitive play that employs a significantly lower cover to core weight ratio that facilitates enhanced performance characteristics without significant change in the core dimensions.

Yet another object of the present invention is to provide a ball of the type described with improved wear, feel and handling characteristics without significantly compromising the traditional characteristics associated with leather covered balls, particularly the impact sound or "crack" when smack by a bat.

A still further object is to provide a synthetic stitched cover ball utilizing a cover of durable, fiber-reinforced polyurethane in place of the finer grades of leather.

Other objects of the invention will be in part obvious and in part pointed out more in detail hereinafter.

These and related objects are achieved by providing a game ball for diamond sports comprising a core and a cover encasing the core wherein the ball has a cover to core weight ratio substantially less than 0.2. The cover preferably is made from a urethane impregnated fibrous web having a microporous structure that contributes to the leather-like tactile qualities of the cover. In a preferred form of the invention, the cover to core weight ratio is less than 0.18.

A better understanding of the objects, advantages, features, properties and relationships of the invention will be obtained from the following detailed description wherein the features of construction, combination of elements and arrangement of parts will be exemplified and are indicative of the way in which the principles of the invention are employed.

DETAILED DESCRIPTION OF THE INVENTION

Figure 1:
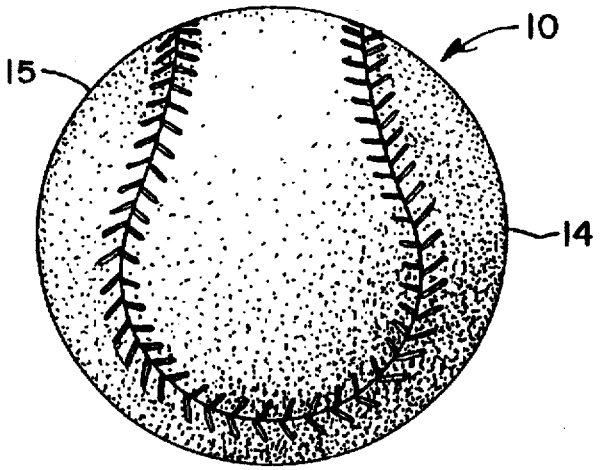
FIG. 1 shows a softball which is constructed according to the present invention.

While it is believed the present invention will have application to all game balls used in diamond sports, for ease of illustration and simplicity of understanding, it will be described in connection with softballs.

In compliance with all current softball association specifications, a regulation slow pitch "12 inch" softball should have a circumference of 11⅞–12½ (about 30.5 cm), a weight of 6–7¼ ounces (170.1–205.5 grams), and a coefficient of restitution (C.O.R.) for traditional flight balls of no more than 0.500 when measured at 88 feet per second. Regulation "11 inch" balls are essentially one inch smaller in circumference, weigh about 165–175 grams, and exhibit the same C.O.R. The ball consists of two primary components, a core that constitutes the major portion of the ball's mass and weight and a stitched cover that encloses the core. The cores preferably are substantially solid members and can be formed from conventional core materials, such as cork, kapok, polyurethane, ionomers, synthetic rubber, and other polymeric materials. Some cores may include a filament wound wrapping, but the preferred core for the softballs of the present invention do not include such wrapping. The size of the cores will depend upon the thickness of the cover, as the balls normally are made to meet the abovementioned exterior size standards and regulation dimensions of all softball associations.

The core of a traditional softball typically will have a weight in the range of 135–150 grams while a total ball weight ranges from 175 to 195 grams. Thus, the covers of traditional softballs may vary from about 30 to about 60 grams with the average cover weight being about 40–45 grams. This results in a cover to core weight ratio ranging between about 0.2 and 0.45 with the average ratio being greater than 0.25.

While, in accordance with the present invention, the size of the core preferably remains unchanged or is only slightly larger than cores which are surrounded by genuine leather covers, the weight of the core is significantly increased since the invention provides for a cover having a thickness and weight significantly less than that of a genuine leather cover. By increasing the weight of the core that accounts for a substantial portion of the ball's C.O.R. and putting a cover of reduced weight over the core, there is greater control over the ball's C.O.R. and less reduction thereof by the softer cover material. As a result, flight distance characteristics are improved since the impact of the bat is transmitted with less absorptive cushioning by the softer cover component.

One embodiment of the core used in the present invention, therefore, is about 15 grams heavier than the traditional core with weights ranging from about 155 grams to about 165 grams for 12 inch balls. The total ball weight remains substantially unchanged at about 178–185 grams. This results in a cover weight of about 17–20 grams and a cover to core weight ratio well below 0.2 and preferably below 0.18, with a typical ratio range being about 0.08 to 0.16 and preferably about 0.09 to 0.13. It will be appreciated that smaller balls, such as the 11 inch ball, will have a cover of substantially the same thickness but of lighter weight due to the reduced amount of material forming the cover. Nevertheless, even at a cover weight of about 14–17 grams, the cover to core weight ratio of the present invention does not change substantially from those set forth.

Due to the high durability of the cover material which is used according to the present invention, the softball covers of this first embodiment can be thinner than leather covers which have the same durability. It has been found that the cover thickness of the first embodiment of the present invention can be 10–20% less than the thickness of leather covers having the same durability. Thus, the thickness of the cover can preferably be reduced to about 0.045–0.055 inch. This type of cover preferably is made of a urethane impregnation of fibers having a denier of about 0.005–0.010, which corresponds to a diameter of about 0.5–1 microns. Because the balls of the invention have a synthetic leather cover which is even thinner than the covers of comparable balls having genuine leather covers, the impact when struck with a bat provides the same sharp, crack-like sound that players have come to associate with leather covers and high performance softballs.

Another embodiment of the core used in the present invention is about 11–14 grams heavier than a traditional core and has a weight of about 151–164 grams. This core is used in conjunction with a cover having a weight of about 20–24 grams, thereby providing a ball with a cover to core weight ratio of 0.12–0.16. Covers of this type preferably have a thickness in the range of 0.050–0.065 inches, and more preferably 0.055–0.061 inches. The cover preferably is a urethane impregnation of fibers having a denier of about 0.10–0.20, which corresponds to a diameter of about 3.3–6.6 microns.

A ball's coefficient of restitution (C.O.R.) is the ratio of the relative velocity of the ball after direct impact to that before impact. One way to measure the coefficient of restitution is to propel a ball at a given speed against a hard massive surface, and measure its incoming velocity and outgoing velocity. The coefficient of restitution is defined as the ratio of the outgoing velocity to incoming velocity of a rebounding ball and is expressed as a decimal. The typical incoming test velocity is 88 feet per second. As a result, the coefficient of restitution can vary from zero to one, with one being equivalent to an elastic collision and zero being equivalent to an inelastic collision.

It is for softballs to have as hi a coefficient of as is possible while meeting association specifications. The coefficient of restitution of a traditional flight softball must be 0.500 or less. An uncovered softball core will have a somewhat higher coefficient of restitution since the softer cover will tend to reduce the C.O.R. of the final covered ball.

Generally, a high performance softball with a solid polyurethane core will have a compression of 0.006–0.012 inches and preferably about 0.007–0.008 inches. The compression is measured in an apparatus having an indentation in which the ball is placed. The ball is secured by a mount opposite the indentation. Once the ball is held in place, compensation is made for the securing force and a gauge in an associated measuring apparatus is set at zero. A ten pound weight is then placed on the mount so as to bear on the ball between the mount and the indentation and an immediate measurement is taken and recorded. The test is conducted six times, two each at the poles, the sides, and the equator. The results are averaged to obtain the final compression reading.

The cover of the softball according to the invention is a two piece stitched cover with each piece having a conventional dumbbell shape. The cover typically is stitched with conventional herringbone stitching. However, other stitching patterns also can be used. It has been found that a softball cover according to the first embodiment of the invention having a thickness of 0.030–0.060 inches, and preferably 0.045–0.055 inches, will provide a durability which is better than that of a coated split leather cover having a 10–20% greater thickness of about 0.055–0.060 inches.

The texture and feel of a softball are important for both throwing and catching as well as hitting, and the object in making synthetic leather covers generally has been to replicate the characteristics of genuine leather covers. The cover of the invention results in a softball having a feel and texture which closely replicates the freer grain leather covers. The cover of the invention will yield slightly to finger pressure applied by the player to provide a firm comfortable grip on ball without excessive give. Thus, the soft texture improves the grip for throwing without compromising hitting performance. In fact, the ball of the present invention exhibits improved performance since the improved spin and loft results in improved distance. Further, because of the spin, there is a minimized "knuckling" effect on direct hit balls.

Figure 2:
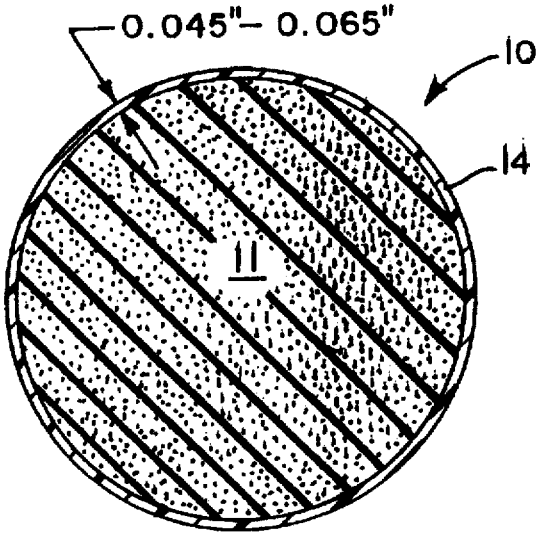
FIG. 2 is a cross sectional view of the softball shown in FIG. 1.

An embodiment of a softball according to the invention is shown in the Figures, and is designated as 10. Referring first to FIGS. 1 and 2, the softball 10 includes a core 11 and a cover 14 which is held in place on the ball by stitching 15. The core 11 of the ball can be manufactured in a conventional manner. The preferred cores are single component members made of polyurethane and formed using low pressure or high pressure molding techniques.

Figure 3:
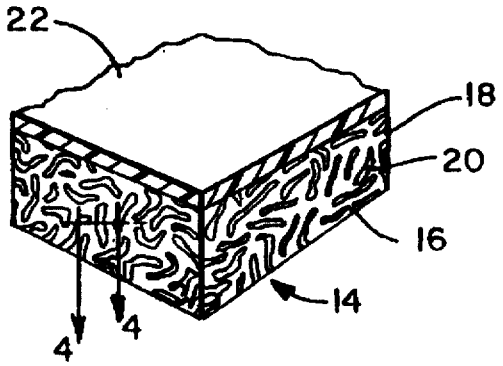
FIG. 3 is an enlarged perspective view of a segment of the cover material used to form the softball of FIG. 1, showing the internal structure thereof in an exaggerated form.
Figure 5:
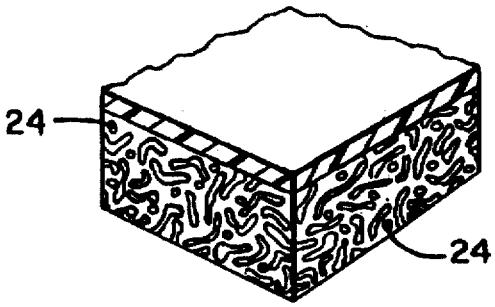
FIG. 5 is an enlarged perspective view of an embodiment of softball cover material showing fibers and micropores in an exaggerated form
Figure 4:
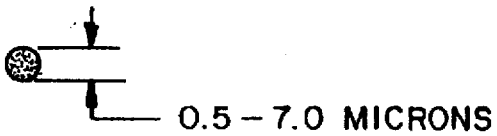
FIG. 4 is a cross sectional view, shown in an enlarged form, of a fiber used to form the cover material for the softball of the present invention.

The cover 14 is constructed from two segments which are of substantially the same dumbbell shape as the two segments of cover material used on a conventional stitched softball. While various polyurethane covers may be used, particularly satisfactory results have been obtained from a urethane impregnated substrate of a non-woven monofilament fibrous web material 16, which is shown in an exaggerated form in FIG. 3. The urethane 18 encases the fibers 20 such that no fibers are visible on the outer surface, although the fibers on the undersurface may be visible prior to adhesive application to the core. The fibers are made of a polymeric material, preferably a polyamide, such as Nylon, or a polyester, and, as shown in FIG. 4, have an individual extremely fine thickness of 0.5–1 microns for the first embodiment. Fibers having a somewhat higher value of thickness, e.g. about 3–7 microns preferably are used in the second embodiment. A thin top coat 22 of polyurethane or another suitable top coat material is applied over the impregnated substrate 16. Examples of polyurethane impregnated fibrous cover materials are more fully described in U.S. Pat. No. 5,310,178, and the disclosure therein is incorporated herein by reference. The material is not only fiber reinforced, but also exhibits a microporous cellular structure with micropores 24, shown in FIG. 5, that contributes to the soft, leather-like tactile quality of the material. The soft feel and flexible texture also can be enhanced by the grain-like pattern applied to the outer surface to simulate the visual appearance of a leather cover.

The polyurethane layer includes a plurality of monofilament polymeric fiber material, preferably a polyamide, such as nylon, for example Nylon 6, or a polyester, compressed together in an array to form a mat with polyurethane material located above, below, and throughout the spaces between the fibers. Such fibers have a diameter of about 0.5–7 microns. On the exterior surface of the cover, a grain-like pattern of raised portions in an irregular pebble-like pattern, is formed to simulate leather. The exterior surface is also then preferably painted to simulate grain leather.

The process for preparing the cover material, when considered in greater specificity includes the preparation of the substrate which is prepared by providing a nonwoven mat of fibers of Nylon or polyester. Each fiber optionally is coated with a starch.

More specifically, a solution of polyurethane elastomer, with sorbitan monostearate and stearyl alcohol as optional additives in an amount of a few percent by weight, is forced in to the non-woven fabric of needle punched mat fibers which have a core of, e.g., Nylon 6 and an outer shell of, e.g., low density polyethylene (LDPE) and the solution impregnates the non-woven fabric. Then, the base material with the polyurethane impregnation is put into an aqueous solution. This coagulates the solution of polyurethane elastomer and, during this wet coagulation process, the polyurethane elastomer forms a microporous structure to form a cellular plastic. In this coagulation process, the additives work as an accelerator to get more micropores and/or as a controller of the size of the pores. The coagulation process provides for part of the soft feel of the cover material.

The sheet material formed by the above described process is then washed in DMF, and is subsequently dipped in toluene for a period of time sufficient to dissolve off the LDPE outer shell of the fiber. At the same time, the special additives, if used, are extracted or removed out of the sheet material for softening of the material. If the fibers have been coated with a starch, a certain amount of starch deposited on the surface of non-woven fabric has, at this time, already been removed out of the sheet materials during the process of coagulation.

The extracted sheet material is dried. Subsequently, a top coat of polyurethane or another suitable top coat material is applied to the sheet material by, e.g., lamination, or a gravure or knife coating process.

The cover material alone, when tested for physical properties and compared to current raw material specifications for both leather and polyvinyl-chloride, meets or exceeds all specification requirements for softball covers. Accordingly, the cover material can be appropriately stitched over proper sized cores to meet not only manufacturing requirements for the balls, but also the standard impact and field play requirements for durability.

The cover material is secured to the core in a conventional manner including the use of adhesives. This can involve the use of various known cements, but typically a urethane adhesive is employed.

From a subjective standpoint, the difference between the polyurethane cover and other synthetics is obvious to the touch. The ball which is produced With the above-described polyurethane has a distinctly softer feel which results in improved ball control. The material described above differs from other known synthetic softball covers in that the other known synthetics have a harder, more plastic-like feel. After normal wear, the covered ball of the present invention retains its soft feel and develops increased tackiness as a result of the backing of the fibers becoming exposed, as more fully described in U.S. Pat. No. 5,310,178. This quality is similar to the wear characteristics of leather. On the other hand, conventional synthetics tend to acquire a rubber-like feel after extended use.

As will be apparent to persons skilled in the art, various modifications and adaptations of the structure above described will become readily apparent without departure from the spirit and scope of the invention.

What is claimed is:

1. A game ball for use in diamond sports comprising a spherical core, and a stitched cover encasing the core, the ball having a stitched cover to core weight ratio of less than 0.18, said ball complying with standardized regulations for said diamond sport.

2. The game ball of claim 1, wherein the stitched cover to core weight ratio is in the range of 0.08–0.16.

3. The ball of claim 1, wherein the weight ratio falls substantially within the range of 0.12–0.16.

4. The game ball of claim 1, wherein the weight ratio falls substantially within the range of 0.09–0.13.

5. The game ball of claim 1, wherein the stitched cover has a weight of up to about 20 grams.

6. The game ball of claim 1, wherein the ball has a circumference of about 12 inches and the stitched cover has a weight of up to about 24 grams.

7. The game ball of claim 1, wherein the core has a weight equivalent to about 155–165 grams for a 12 inch circumference ball.

8. The game ball of claim 1, wherein the stitched cover has a weight equivalent to about 17–24 grams for a 12 inch circumference ball.

9. The game ball of claim 1, wherein the stitched cover is a fiber reinforced polyurethane material.

10. The game ball of claim 9, wherein the fibers have a diameter of about 0.5–7 microns.

11. The game ball of claim 9, wherein the fibers have a diameter of about 0.5–1 microns.

12. The game ball of claim 9, wherein the fibers have a diameter of about 3–7 microns.

13. The game ball of claim 1, wherein the stitched cover includes a microporous, polyurethane impregnated fibrous web material.

14. The game ball of claim 1 wherein the ball exhibits a sound comparable to that of a leather covered ball, when struck with a bat.

15. A game ball for use in diamond sports comprising a spherical core, and a stitched cover formed from a substrate of nonwoven synthetic fibers impregnated with a polyurethane, the synthetic fibers being a polymeric material, the impregnated substrate having a thickness of 0.003–0.065 inches, the game ball having a stitched cover to core weight ratio of less than 0.18.

16. The game ball of claim 15, wherein the impregnated substrate has a thickness of 0.045–0.055 inch.

17. The game ball of claim 15, wherein the impregnated substrate has a thickness of 0.055–0.065 inch.

18. The game ball of claim 15, wherein the nonwoven fibers are in the form of a nonwoven web material and the stitched cover has a microporous cellular structure.

19. The game ball of claim 15, wherein the fibers in the stitched cover are selected from the group consisting of polyamide and polyester fibers.

20. The game ball of claim 15, wherein the ball has a stitched cover to core weight ratio within the range of 0.08–0.16.

* * * * *

UNITED STATES PATENT AND TRADEMARK OFFICE

CERTIFICATE OF CORRECTION

PATENT NO. : 5,664,774
DATED : September 9, 1997
INVENTOR(S) : Alan D. Walker and John Jaszek It is certified that error appears in the above-identified patent and that said Letters Patent is hereby corrected as shown below:

Title page, insert the following:

In the first column, line 5, correct the spelling of the inventor's surname as follows:

" Uaszek" to - Jaszek -

In the first column, in the line after " Filed: Dec. 15, 1995" , insert the following:

- Related U.S. Application Data
Continuation-in-part of Ser. No. 08/291,800, filed Aug. 17, 1995, abandoned. -

UNITED STATES PATENT AND TRADEMARK OFFICE

CERTIFICATE OF CORRECTION

PATENT NO. : 5,664,774

DATED : September 9, 1997

INVENTOR(S) : Alan D. Walker and John Jaszek

It is certified that error appears in the above-identified patent and that said Letters Patent is hereby corrected as shown below:

column 1, line 5, insert the following paragraph:

- This application is a continuation-in-part of U.S. patent application, Serial No. 08/291,800, filed August 17, 1994 and now abandoned. -

Signed and Sealed this

Thirteenth Day of April, 1999

*Attest:*

*Attesting Officer*

Q. TODD DICKINSON

*Acting Commissioner of Patents and Trademarks*